US008887811B2

(12) United States Patent
Hofman et al.

(10) Patent No.: US 8,887,811 B2
(45) Date of Patent: Nov. 18, 2014

(54) DOWNHOLE TOOL WITH EXPANDABLE SEAT

(71) Applicant: Peak Completion Technologies, Inc., Midland, TX (US)

(72) Inventors: Raymond A. Hofman, Midland, TX (US); Steve Jackson, Richmond, TX (US)

( * ) Notice: Subject to any disclaimer, the term of this patent is extended or adjusted under 35 U.S.C. 154(b) by 0 days.

(21) Appl. No.: 13/936,805

(22) Filed: Jul. 8, 2013

(65) Prior Publication Data

US 2013/0292125 A1 Nov. 7, 2013

Related U.S. Application Data

(63) Continuation of application No. 12/702,169, filed on Feb. 8, 2010, now Pat. No. 8,479,822.

(51) Int. Cl.
*E21B 34/00* (2006.01)
*E21B 34/14* (2006.01)
*E21B 34/06* (2006.01)

(52) U.S. Cl.
CPC ..... *E21B 34/14* (2013.01); *E21B 34/063* (2013.01)
USPC ..... 166/318; 166/317; 166/328

(58) Field of Classification Search
CPC .. E21B 34/063; E21B 34/14; E21B 2034/007
USPC ..... 166/317, 318, 328, 334.4, 193
See application file for complete search history.

(56) References Cited

U.S. PATENT DOCUMENTS

| | | | | | |
|---|---|---|---|---|---|
| 4,510,994 | A * | 4/1985 | Pringle | 166/156 |
| 4,842,062 | A * | 6/1989 | Schneider et al. | 166/154 |
| 5,425,424 | A * | 6/1995 | Reinhardt et al. | 166/291 |
| 6,003,607 | A * | 12/1999 | Hagen et al. | 166/381 |
| 6,053,250 | A * | 4/2000 | Echols | 166/317 |
| 6,634,428 | B2 * | 10/2003 | Krauss et al. | 166/317 |
| 7,322,417 | B2 * | 1/2008 | Rytlewski et al. | 166/313 |
| 7,681,645 | B2 * | 3/2010 | McMillin et al. | 166/291 |
| 2006/0243455 | A1 * | 11/2006 | Telfer et al. | 166/386 |
| 2008/0093080 | A1 * | 4/2008 | Palmer et al. | 166/318 |
| 2009/0308588 | A1 * | 12/2009 | Howell et al. | 166/66.4 |
| 2009/0308614 | A1 * | 12/2009 | Sanchez et al. | 166/328 |
| 2011/0036590 | A1 * | 2/2011 | Williamson et al. | 166/373 |
| 2011/0139433 | A1 * | 6/2011 | Jackson et al. | 166/63 |
| 2011/0198100 | A1 * | 8/2011 | Braekke et al. | 166/386 |

* cited by examiner

*Primary Examiner* — Kenneth L Thompson
*Assistant Examiner* — Michael Wills, III

(57) ABSTRACT

A downhole tool comprising a housing having at least one flow port disposed providing a communication path between the interior and exterior of the sleeve. A sleeve assembly has an expandable seat and an inner sleeve, and is moveable within the housing between a first position and a second position, wherein in the first position the sleeve assembly is radially positioned between the flow ports and the flowpath to substantially prevent fluid communication. Shearable port inserts are positioned within the flow ports, with each port insert having a shearable portion extending into the interior of the housing and engaging the sleeve assembly when the inner sleeve is in said first position.

14 Claims, 4 Drawing Sheets

DOWNHOLE TOOL WITH EXPANDABLE SEAT

CROSS-REFERENCES TO RELATED APPLICATIONS

This is a continuation application claiming the benefit of the filing date of U.S. application Ser. No. 12/702,169, filed Feb. 8, 2010, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to a downhole tool for oil and/or gas production. More specifically, the invention is a well stimulation tool having an expandable seat for use with a tubing string disposed in a hydrocarbon well.

2. Description of the Related Art

In hydrocarbon wells, fracturing (or "fracing") is a technique used by well operators to create and/or extend a fracture from the wellbore deeper into the surrounding formation, thus increasing the surface area for formation fluids to flow into the well. Fracing is typically accomplished by either injecting fluids into the formation at high pressure (hydraulic fracturing) or injecting fluids laced with round granular material (proppant fracturing) into the formation.

Fracing multiple-stage production wells requires selective actuation of downhole tools, such as fracing valves, to control fluid flow from the tubing string to the formation. For example, U.S. Published Application No. 2008/0302538, entitled Cemented Open Hole Selective Fracing System and which is incorporated by reference herein, describes one system for selectively actuating a fracing sleeve that incorporates a shifting tool. The tool is run into the tubing string and engages with a profile within the interior of the valve. An inner sleeve may then be moved to an open position to allow fracing or to a closed position to prevent fluid flow to or from the formation.

That same application describes a system using multiple ball-and-seat tools, each having a differently-sized ball seat and corresponding ball. Ball-and-seat systems are simpler actuating mechanisms than shifting tools and do not require running such tools thousands of feet into the tubing string. Most ball-and-seat systems allow a one-quarter inch difference between sleeves and the inner diameters of the seats of the valves within the string. For example, in a 4.5-inch liner, it would be common to drop balls from 1.25-inches in diameter to 3.5-inches in diameters in one-quarter inch or one-eighth inch increments, with the smallest ball seat positioned in the last valve in the tubing string. This, however, limits the number of valves that can be used in a given tubing string because each ball would only be able to actuate a single valve, the size of the liner only provides for a set number of valves with differently-sized ball seats. In other words, because a ball must be larger than the ball seat of the valve to be actuated and smaller than the ball seats of all upwell valve, each ball can only actuate one tool.

BRIEF SUMMARY OF THE INVENTION

The present invention allows a well operator to increase the number of flow ports to the formation in each stage of a formation and to supplement the number of flow ports in unlimited numbers and multiple orientations to increase the ability of fracing the formation.

The present invention is a downhole tool comprising a housing having at least one flow port providing a communication path between the interior and exterior of the tool. A sleeve assembly containing an inner sleeve and an expandable seat is moveable within the housing between a first position and a second position. In the first position, the sleeve assembly is radially positioned between the flow ports and the flowpath to substantially prevent fluid communication therebetween. Shearable port inserts are initially positioned within the flow ports, with each port insert having a shearable portion extending into the interior of the housing and engaging the sleeve assembly when the inner sleeve is in the first position.

According to one aspect of the present invention, the expandable seat is comprised of a plurality of seat segments connected to a plurality of elastomeric members. Upon application of sufficient pressure, the ball engages the expandable seat substantially preventing fluid from flowing through the expandable seat. When an adequate pressure differential is caused above and below the engaged ball, the differential forces the sleeve assembly to shear the port inserts and move to the second position. Continued pressure differential of at least that pressure thereafter causes radial expansion of the elastomeric members and separation of the seat segments relative to the expandable seats unstressed state, allowing the ball to proceed through the expandable seat. In this manner, a single ball may be used to actuate multiple downhole tools within the same tubing string.

DETAILED DESCRIPTION OF THE INVENTION

When used with reference to the figures, unless otherwise specified, the terms "upwell," "above," "top," "upper," "downwell," "below," "bottom," "lower," and like terms are used relative to the direction of normal production through the tool and wellbore. Thus, normal production of hydrocarbons results in migration through the wellbore and production string from the downwell to upwell direction without regard to whether the tubing string is disposed in a vertical wellbore, a horizontal wellbore, or some combination of both. Similarly, during the fracing process, fracing fluids moves from the surface in the downwell direction to the portion of the tubing string within the formation.

Figure 1:
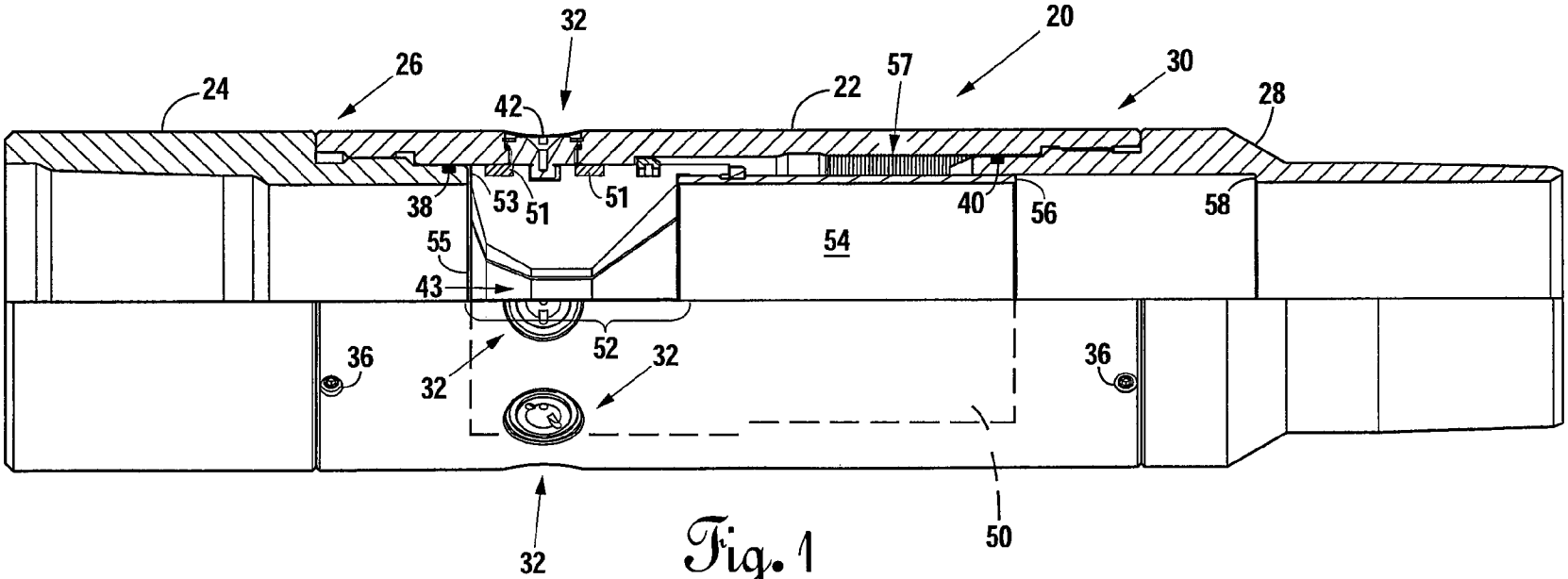
FIG. 1 is a partial sectional elevation of the preferred embodiment of the present invention in a "closed" state wherein fluid communication through flow ports is substantially prevented.

FIG. 1 depicts a partial sectional elevation of a preferred embodiment of a downhole tool 20 having the features of the present invention. The tool 20 comprises a housing 22 attached to a top connection 24 at an upper end 26 and a bottom connection 28 at a lower end 30, respectively. Grub screws 36 secure the connection between the housing 22 and the top and bottom connections 24, 28. Annular upper and lower sealing elements 38, 40 are positioned circumferentially around the top connection 24 and bottom connection 28, respectively, and inside the housing 22. The inner surface of the housing 22 includes a locking section 57 having a plurality of downwardly-directed annular ridges.

Figure 3:
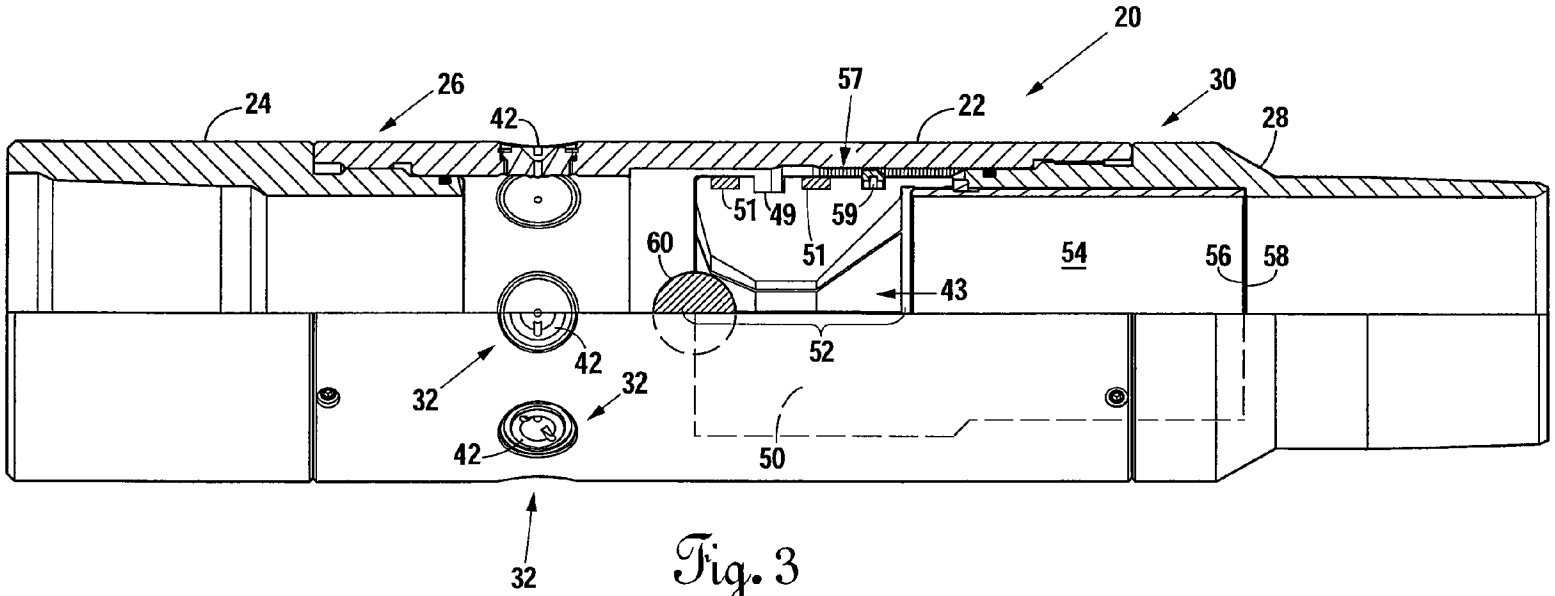
FIG. 3 is a partial sectional elevation of the preferred embodiment of the present invention in an "opened" state wherein fluid communication through the flow ports is permitted.

A plurality of flow ports 32 is circumferentially positioned around and through a first section of the housing 22 having a first inner diameter. The flow ports 32 provide a number of fluid communication paths between the interior and exterior of the tool 20. A sleeve assembly 50 nested within the housing 22 comprises an expandable seat 52 and an inner sleeve 54, and is moveable between a first position, as shown in FIG. 1, and a second position as shown in FIG. 3. The expandable seat 52 has an annular upper shoulder 53 adjacent the top connection 24, and an annular lower shoulder 56 adjacent to inner sleeve 54, with a seat flowpath 43 extending longitudinally therebetween. Two annular sealing elements 51 are circumferentially disposed around the expandable seat 52 in corresponding circumferential grooves.

In the first position, the expandable ball seat 52 is positioned in the first section of the housing 22, with the upper shoulder 53 contacting a lower annular shoulder 55 of the top connection 24. The outer diameter of the expandable seat 52 in a normal state is only slightly smaller than the inner diameter of the first section of the housing 22.

Figure 2:
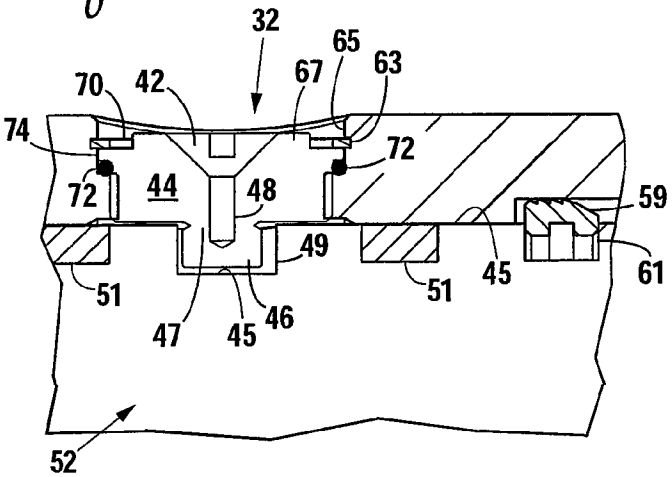
FIG. 2 is an enlarged sectional elevation of the port insert shown in FIG. 1.

FIG. 2 shows a sectional view of a shearable port insert 42 in greater detail, with hatching removed for clarity. In the first position, the port insert 42 is positioned in the flow port 32 to close the communication path to the exterior of the housing 22. The shearable port insert 42 comprises a cylindrical body portion 44 having approximately the same circumference as the corresponding flow port 32, and a cylindrical shearable portion 46 extending into the interior of the housing 22 and having a smaller circumference than the body portion 44. The junction of the shearable portion 46 and body portion 44 is a shear joint 47 created with a shear riser cut and shearable at a predetermined amount of shear force, which in the preferred embodiment can be adjusted between eight hundred psi and four thousand psi by altering the depth of the stress riser cut. A channel 48 extends through the body portion 44 and partially through the shearable portion 46 such that, once sheared, the channel 48 provides a fluid communication path through the port insert 42 between the interior and exterior of the housing 22.

In the first position, the shearable portion 46 of each port insert 42 extends into a corresponding circumferential insert groove 49 in the outer surface 45 of the expandable seat 52. Two annular sealing elements 51 are disposed circumferentially around the expandable seat 52 in two circumferential grooves. Alternative embodiments contemplate a plurality of recesses formed in the outer surface 45 of and spaced radially about the expandable seat 52 and aligned with the port inserts 42.

The port insert 42 is retained in the flow port 32 with a snap ring 70 disposed in a groove 63 formed in the sidewall 65 of the flow port 32. The snap ring 70 constricts around a cylindrical top portion 67 of the port insert 42. An annular sealing element 72 is located between an annular shoulder portion 74 of the port insert 42 to prevent fluid communication into or out of the flow ports 32 around the exterior of the port insert 42. An exemplary snap ring 70 is Smalley Snap Ring XFHE-0125-502.

In the preferred embodiment, the port inserts 42 are made of erodible (i.e., non-erosion resistant) material (e.g., 6061-T651 or 7075-T651 aluminum alloy) such that flow of fracing fluid through the channel 48 at typical fracing flow rates erodes the insert 42 to increase the diameter of the channel 48. When sheared as a system, the port inserts 42 will erode to or past the internal sidewall of the housing 22 as a result of downwell flow, which thereafter allows the full open flow area of the tubing to be used for upwell or downwell flow. In alternative embodiments, however, the port inserts may be constructed of an erosion resistant material when the full flow area of the housing 22 is not desired.

An expandable ratchet ring 59 is positioned circumferentially around the outer surface 45 of the expandable seat 52, downwell from the cylindrical insert groove 49, in a snap ring groove 61, and has a plurality of upwardly-directed ridges engagable with the locking section 57 to prevent upwell movement. Operation of the ratchet ring 59 will be described more fully with reference to FIG. 3 and FIG. 5 infra.

Figure 4:
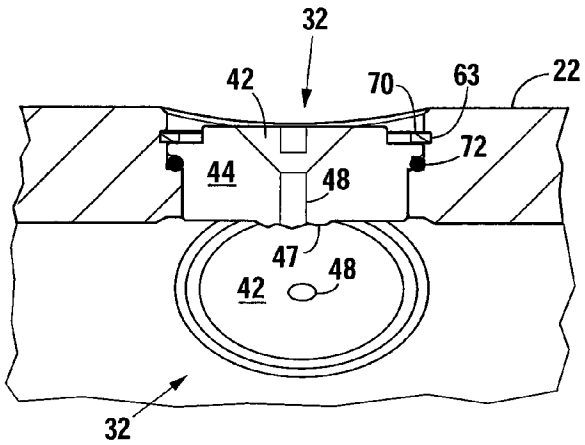
FIG. 4 is an enlarged sectional view of the port insert shown in FIG. 3.

FIG. 3 and FIG. 4 more fully show the downhole tool 20 in an "opened" state, wherein the sleeve assembly 50 is in the second position. The port inserts 42 are sheared at the shear joints 47 to provide a communication path from the interior to the exterior of the tool 20 through the channel 48. The lower end 56 of the inner sleeve 54 contacts the lower annular shoulder 58 of the bottom connection 28. The ratchet ring 59 is engaged with the locking section 57 of the housing 22 to prevent upwell movement of the sleeve assembly 50 due to flow pressure or friction load during remedial completion operations. A ball 60 is seated against the expandable seat 52 to prevent further downwell fluid flow. FIG. 3 does not show the expandable seat 52 in a radially expanded state and is the precursor stage prior to the ball 60 being forced through the expandable seat 52, as will be discussed infra.

Figure 5:
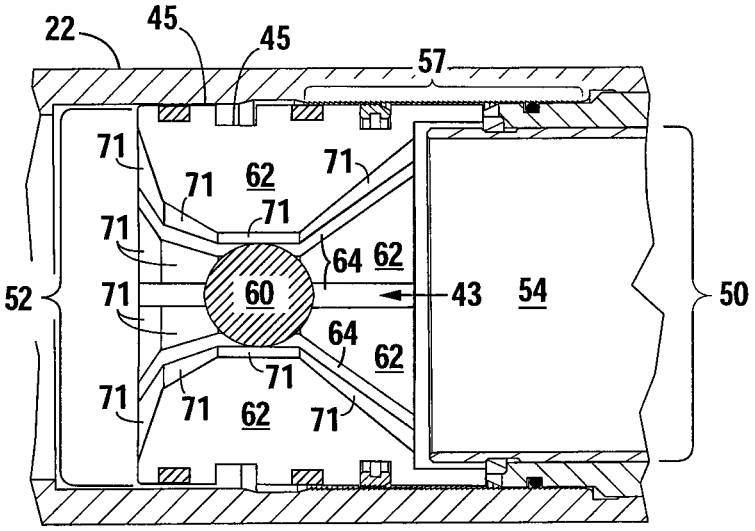
FIG. 5 is a sectional elevation of the expandable seat of the preferred embodiment.

FIG. 5 more fully shows the expandable seat 52 in a radially expanded state nested within a second section of the housing 22 in the second position. The expandable seat 52 is comprised of a plurality of seat segments 62 interconnected with elastomeric members 64 in a generally tubular shape with outwardly flared upper and lowered ends, with each seat segment 62 having an inner surface 71 partially defining the seat flowpath 43. The elastomeric members 64 are bonded to the seat segments 62 with a suitable bonding agent. Although in the preferred embodiment the expandable seat 52 is attached to the inner sleeve 54, in alternative embodiments the expandable seat 52 may be integrally formed with the inner sleeve 54 at an end thereof. The elastomeric members 64 are preferably formed of HNBR rubber.

Figure 6:
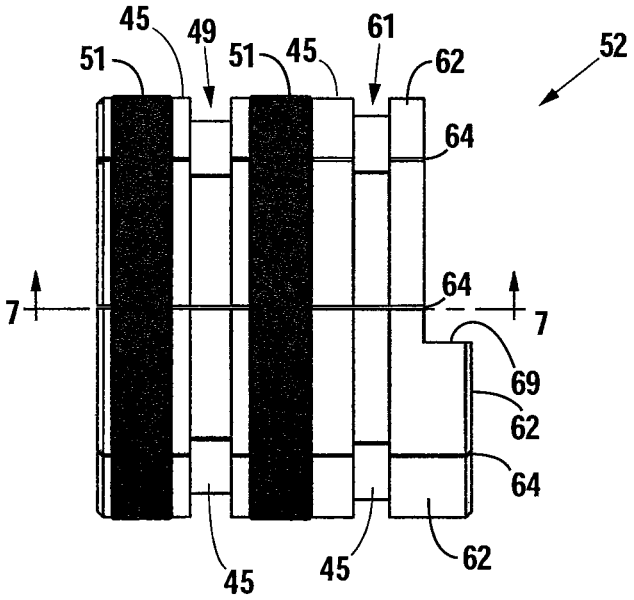
FIG. 6 is side elevation of the expandable seat of the preferred embodiment.
Figure 7:
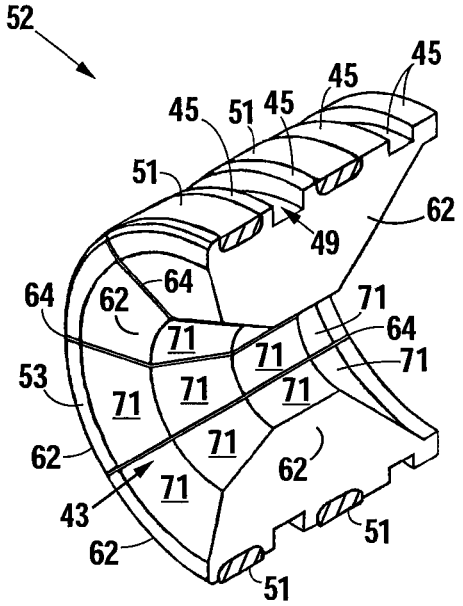
FIG. 7 is a sectional view of the expandable seat through section line 7-7 of FIG. 6.

FIG. 6 is an elevation of the expandable ball seat 52 and annular sealing elements 51 shown in FIG. 5. FIG. 7 is a sectional perspective through section line 7-7 of FIG. 6. The expandable seat 52 is formed with eight seat segments 62 interconnected with the elastomeric members 64. The annular sealing elements 51 are circumferentially disposed in grooves formed in and around the seat segments 62. A portion of each of the grooves is formed in the outer surface 45 of each seat segment 62. Seven of the seat segments 62 are identically shaped, with the eight seat segment having a clutch profile 69 that engages with a profile of bottom connection to prevent rotation during milling out of the tool. The elastomeric members 64 are in the unstressed configuration shown in FIG. 1 and FIG. 3. When in the first position and prior to shearing, the port inserts are engaged with the circumferential insert groove 49. The ratchet ring groove 61 receives the expandable ratchet ring for engagement with a locking section of the housing.

Figure 8:
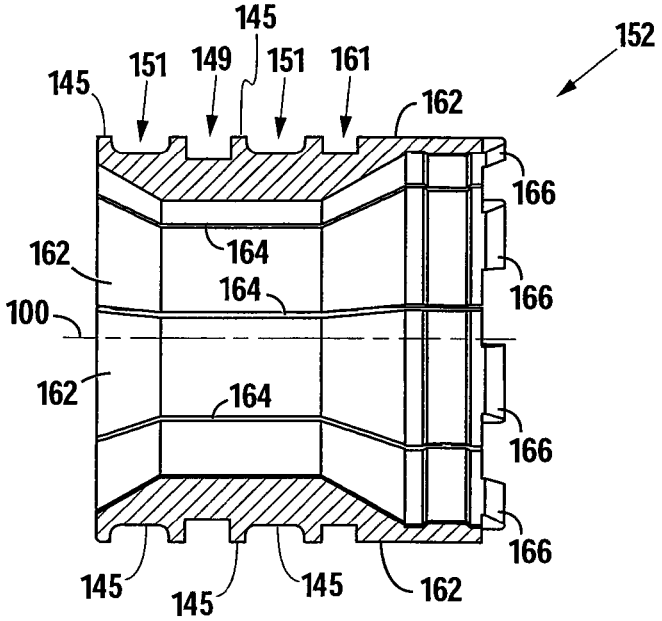
FIG. 8 is a section view of an alternative embodiment of an expandable seat.

FIG. 8 is a sectional elevation through a plane intersecting the longitudinal axis 100 of an alternative embodiment of an expandable seat 152 comprising only six seat segments 162 interconnected with elastomeric members 164. Grooves 151 are formed around the seat segments 162 to receive annular sealing elements. An insert groove 149 is circumferentially formed in the outer surface 45 between the sealing element grooves 151 for engagement with the port inserts when in the first position. A ratchet ring groove 161 receives an expandable ratchet ring for engagement with a locking section 57 of the housing 22. A series of tabs 166 are spaced around the lower end of, and extend longitudinally from, the expandable seat 152 to engage with the bottom shoulder of an alternative embodiment of a bottom connection (not shown), thus preventing rotation of the seat 152 during milling out.

Operation of the invention is initially described with reference to FIG. 1 and FIG. 2. While in the first position, the associated ball 60 (not shown) flows down the tubing string and seats against the seat segments 62 and elastomeric members 64 that compose the expandable seat 52. In this manner, the ball 60 engages with and seals against the expandable seat 52 to substantially prevent fluid flow through the expandable seat 52 and connected inner sleeve 54, causing an increase in pressure applied to the ball 60 and sleeve assembly 50 relative to the pressure below the sleeve assembly 50. When this pressure differential is sufficient to cause the sleeve assembly 50 to exert a shearing force on the port inserts 32 greater than the shear strength of the shear joints 47, the force exerted by the expandable seat 52 separates the shearable portions 46 of the port inserts 42 and releases the sleeve assembly 50. The pressure differential causes downward movement of the sleeve assembly 50, with the ball 60 engaged to the expandable seat 52, to the second position shown in FIG. 3.

As shown in FIGS. 3 and 4, the insert sleeve 54 is impeded from further downwell movement once in contact with the lower annular shoulder 58. After moving to the second position, the ball 60 is impeded from further downwell movement and initially remains engaged with the expandable seat 52, which is in an unstressed state. The ratchet ring 59 engages with the locking section 57 to prevent upwell movement of the sleeve assembly 50.

As a result of the shearing, the channels 48 of the port inserts 42 provide fluid communication paths to the exterior of the housing 22. In this "opened" state, fracing may commence through the channels 48. Flow of fracing material at normal fracing velocities causes erosion of the port inserts 42 and increases the diameter of the channels 48.

As shown in FIG. 5, while the sleeve assembly 50 is in the second position, the ball 60 may be forced through the expandable seat 52 by increasing the pressure differential within the tubing string to overcome the radially-inwardly contracting forces exerted by the elastomeric members 64 on the seat segments 62. As the ball 60 is forced into the expandable seat 52, the elastomeric members 64 expand resulting in increased separation between the seat segments 62 and allowing the ball 60 to pass. Whereas in the first position the outer diameter of the expandable seat is only slightly larger than the first inner diameter of the housing, in the open state the second inner diameter of the housing 22 is sufficiently large to permit outward expansion of the elastomeric members 64 such that the seat segments 62 can separate to allow the ball 60 to pass.

After exiting the lower end of the expandable seat 52, pressure within the housing 22 decreases and the expandable seat 52 returns to its unstressed state. The ball 60 continues to travel downwell to the next downhole tool in the tubing string, if any. The furthest downwell tool each stage of a multi-stage well is typically a standard (i.e., non-expandable) seat valve on which the ball 60 would seat to allow the tubing string pressure to be elevated to fracture the isolated stage.

The present invention is described above in terms of a preferred illustrative embodiment of a specifically described downhole tool. Those skilled in the art will recognize that alternative constructions of such an apparatus can be used in carrying out the present invention. Other aspects, features, and advantages of the present invention may be obtained from a study of this disclosure and the drawings, along with the appended claims.

We claim:

1. A downhole tool for use in a hydrocarbon production well, the downhole tool comprising:

a housing defining a flowpath around a longitudinal axis; and a seat radially expandable between a normal state and an expanded state, said seat having a plurality of seat segments and a plurality of elastomeric members, said plurality of seat segments attached to said plurality of elastomeric members in a tubular arrangement in the normal state and in the expanded state;

wherein each elastomeric member is attached to exactly two adjacent seat segments.

2. The downhole tool of claim 1 wherein each elastomeric member is a non-tubular body.

3. The downhole tool of claim 1 wherein said plurality of elastomeric members is bonded to said plurality of seat segments with a bonding agent.

4. The downhole tool of claim 1 wherein said plurality of elastomeric members is positioned circumferentially between said plurality of seat segments.

5. The downhole tool of claim 1 wherein each of said plurality of seat segments is attached to exactly two elastomeric members.

6. The downhole tool of claim 5 wherein each elastomeric member is a nontubular body.

7. The downhole tool of claim 1:

wherein each seat segment comprises:

a partially-cylindrical outer surface;

at least one side surface adjacent to said outer surface and extending toward said longitudinal axis;

at least one partially-conical inner surface adjacent to said at least one side surface; and wherein each of said plurality of elastomeric members is attached to two side surfaces of said plurality of seat segments.

8. The downhole tool of claim 7 wherein each elastomeric member is attached to side surfaces of circumferentially adjacent seat segments.

9. A downhole tool for use in a hydrocarbon production well, the downhole tool comprising:

a housing defining a flowpath around a longitudinal axis; and a seat radially expandable between a normal state and an expanded state, said seat having a plurality of seat segments and a plurality of elastomeric members, said plurality of seat segments attached to said plurality of elastomeric members in a tubular arrangement in the normal state and in the expanded state;

wherein each seat segment is attached to exactly two elastomeric members.

10. The downhole tool of claim 9 wherein each elastomeric member is a non-tubular body.

11. The downhole tool of claim 9 wherein said plurality of elastomeric members is bonded to said plurality of seat segments with a bonding agent.

12. The downhole tool of claim 9 wherein said plurality of elastomeric members is positioned circumferentially between said plurality of seat segments.

13. The downhole tool of claim 9 wherein each elastomeric member is attached to exactly two adjacent seat segments.

14. The downhole tool of claim 13 wherein each elastomeric member is a nontubular body.

* * * * *